United States Patent [19]

Cetrelli

[11] 4,284,228

[45] Aug. 18, 1981

[54] PACKING CONTAINERS OF LAMINATED MATERIAL HAVING VENTING MEANS

[75] Inventor: Renato Cetrelli, Lund, Sweden

[73] Assignee: Tetra Pak International AB, Lund, Sweden

[21] Appl. No.: 48,634

[22] Filed: Jun. 14, 1979

[30] Foreign Application Priority Data

Jun. 21, 1978 [SE] Sweden ..... 7807085

[51] Int. Cl.[3] ..... B65D 5/42; B65D 31/14

[52] U.S. Cl. ..... 229/48 R; 229/DIG. 14; 229/62.5; 493/269; 493/156; 156/87; 428/157

[58] Field of Search ..... 229/48 R, DIG. 14, 485 A, 229/62.5, 3.1, 48 T, 17 R; 426/113, 118, 127, 412, 407; 93/94 PS, 94 R, 39.1 P; 428/35, 57, 61, 167, 169; 156/217, 218

[56] References Cited

U.S. PATENT DOCUMENTS

| | | | |
|---|---|---|---|
| 2,017,810 | 10/1935 | Bodor et al. | 229/48 R |
| 2,361,344 | 10/1944 | Yates | 229/DIG. 14 |
| 2,633,284 | 3/1953 | Moffett et al. | 229/DIG. 14 |
| 2,723,936 | 11/1955 | Ryan | 229/48 R |
| 2,814,428 | 11/1957 | Magill | 229/48 R |
| 3,017,067 | 1/1962 | Parks | 229/48 R |
| 3,078,768 | 2/1963 | Kuchembecker | 229/48 R X |
| 3,085,737 | 4/1963 | Horton | 229/48 R X |
| 3,243,337 | 3/1966 | Haselow et al. | 229/48 R X |
| 3,370,780 | 2/1968 | Shaw | 229/62.5 |
| 3,937,395 | 2/1976 | Lawes | 229/DIG. 14 |
| 3,979,048 | 9/1976 | Stark et al. | 229/48 T |
| 3,989,182 | 11/1976 | Stearley | 229/62.5 |
| 4,071,187 | 1/1978 | La Fleur | 229/62.5 |

FOREIGN PATENT DOCUMENTS

| | | | |
|---|---|---|---|
| 1127487 | 9/1968 | United Kingdom | 229/DIG. 14 |

*Primary Examiner*—Davis T. Moorhead

*Attorney, Agent, or Firm*—Burns, Doane, Swecker & Mathis

[57] ABSTRACT

A packing container e.g. for sterile milk is manufactured from laminated material which is folded and sealed to the desired container shape. In the seal, cut surfaces facing towards the inside will occur which have to be sealed so as to prevent the central paper layer of the material from absorbing some of the contents. Usually this is done by means of a strip of a plastic material which is impermeable to liquid. When the packing material is sterilized and exposed to high temperatures these strips are often damaged, because the moisture present in the paper layer of the laminate is converted into vapor and penetrates the strip softened by the heat. In accordance with the invention the seal is now ventilated with the help of ducts extending through the seal in such a manner that the vapor can escape to the surrounding air without affecting the sealing strip which thus remains intact and can fulfil its intended sealing function.

13 Claims, 2 Drawing Figures

PACKING CONTAINERS OF LAMINATED MATERIAL HAVING VENTING MEANS

BACKGROUND AND SUMMARY OF THE PRESENT INVENTION

The present invention relates to a packing container of laminated material comprising a seal wherein a first edge area of the laminate is sealed to a second edge area, the side of the seal facing towards the inside of the packing container being covered by means of a liquid-tight material strip. The invention also relates to a packing laminate web for production of the container.

Packing containers for liquid foodstuffs are generally manufactured from the laminated material which comprises a central carrier or base layer of paper or cardboard which is covered on both sides with a thermoplastic material, e.g. polythene. The paper layer in this case has a carrying function, whilst the thermoplastics on the one hand makes the material impermeable to liquid and on the other hand makes possible a heat-sealing of the material without a supplementary adhesive.

A known packing container for milk is manufactured in that a laminated material of the aforementioned type is fed to a packing machine in the form of a web. In the machine the material web is converted to tubular shape, in that the longitudinal edge portions of the material web are made to overlap one another, whereupon they are heated so that the thermoplastic layers reach their softening temperature and are compressed to a longitudinal liquid-tight overlap joint. The filled tube is then converted to a line of connected, cushion-like containers in that the tube at uniform intervals is compressed and sealed in transverse zones. The cushions formed, wholly filled with contents, are subjected moreover to a forming process in the course of which forming jaws give the desired shape, e.g. parallelepipedic shape, to the packages.

The longitudinal overlap joint mentioned above is formed in a known manner in that the two edge areas of the material are placed on top of one another and are heated and compressed to a liquid-tight seal. One edge area will then be located inside the finished container, which means that the cut edge remains unprotected so that the central paper layer of the laminate will come into contact with and absorb some of the contents. To prevent this, the seal is generally provided with a so-called longitudinal joint strip, that is to say, a liquid-tight material strip of the same material as the plastic layer of the laminate, e.g. polythene, which strip, after the sealing is applied over the edge area situated inside the packing container in such a manner that the cut edge itself is sealed off from the interior of the package.

When the packing container described is to be used for the packing of sterile contents, the packing laminate is sterilized with the help of a sterilizing agent, e.g. hydrogen peroxide, which is applied to the packing laminate. After a certain time in contact with the packing laminate the sterilizing agent is removed again, which is done among other things by heating the inside of the packing material tube so such a temperature that the sterilizing agent is evaporated and can be drawn off by ventilation. Since the outside of the material tube during the heating is exposed to a certain amount of cooling by the surrounding air, the packing laminate will not be heated to temperatures which are harmful for the laminate. In the area of the longitudinal joint of the tube, however, where the edge zones overlap one another, the material is so thick that the cooling will be appreciably impaired. This means that the sealing zone is subjected to such a high temperature that the sealing strip commences to melt at the same time as the natural moisture of about 6% enclosed in the paper layer of the laminate is made to evaporate, which is true in particular for the edge area located close to the centre of the material tube. Since the cut edge of the edge area is enclosed underneath the sealing strip, the space underneath the strip will be filled with expanding vapour until the sealing strip, softened up by the heat, is deformed or breaks, so that the vapour can escape from the space between the sealing material strip and the laminate.

Up to now it has been tried to eliminate the difficulties described by designing the sealing material strip in such a manner that the vapour cannot penetrate the same. In a known solution a laminated strip is proposed which had an enclosed core of heat-resistant material, e.g. HD-polythene. This strip has certainly proved to function relatively well, but the manufacture of the strip is complicated and the strip becomes relatively expensive.

It is an object of the present invention to overcome the abovementioned problem and to provide a solution which allows the utilization of an uncomplicated and inexpensive longitudinal joint strip.

This object has been achieved in principle in accordance with the invention in that the longitudinal seal is designed in such a manner that the vapour can be drawn off by ventilation without affecting the sealing strip, and more particularly, the abovementioned object has been achieved in that a packing container of the type described in the introduction has been given the characteristic that ducts are arranged to connect a space present between the material strip and the laminate with the outside air. The ducts make possible a ventilation of the previously closed space underneath the sealing longitudinal strip, as a result of which the vapour produced can directly escape so that no significant vapour pressure is capable of building up.

A preferred embodiment of the arrangement in accordance with the invention has been given the further characteristic that the ducts extend between the surfaces lying against one another in the sealing area.

A further embodiment of the arrangement in accordance with the invention has been given the further characteristic that the ducts in a seal of the overlapping type are in the form of depressions provided in the edge area of the laminate.

A further embodiment of the arrangement in accordance with the invention has been given the further characteristic that the depressions comprise grooves, extending transversely in relation to the longitudinal direction of the seal, which are of a length slightly exceeding the width of the seal.

According to the invention a packing laminate web for production of the packing container has been given the characteristics that one edge area of the web is provided with a series of depressions.

Further embodiments of the packing laminate web in accordance with the invention have been given the characteristics which are evident from reading the specification and claims.

BRIEF DESCRIPTION OF THE DRAWINGS

The invention will now be described in more detail with special reference to the enclosed schematic drawing, wherein.

DETAILED DESCRIPTION OF THE PREFERRED EMBODIMENT

Figure 1:
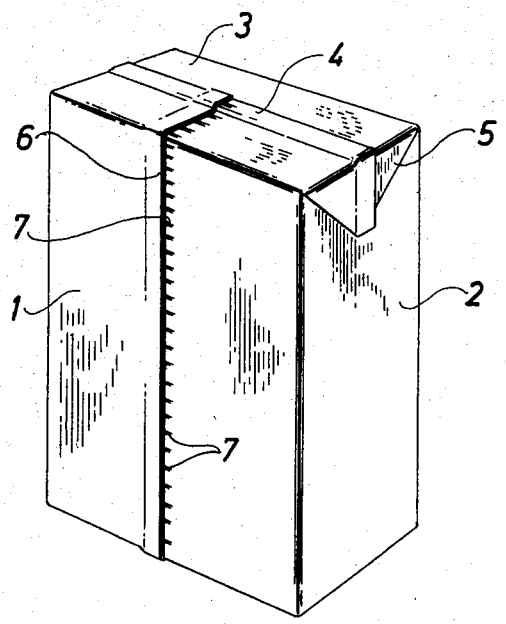
FIG. 1 shows a packing container in accordance with the invention.

The packing container shown in FIG. 1 is of substantially parallelepipedic shape with front and back faces 1, side faces 2 and end faces 3 in parallel pairs, only one of which is apparent in the figure. The two end faces 3 have transverse sealing fins 4 which are folded down so as to rest substantially against the respective end face. Between the end faces 3 and the narrow side faces 2 there are substantially triangular corner lugs 5 of surplus material which for geometric reasons arise when the packing container is converted from cushion shape to parallelepipedic shape. All corner lugs 5 are folded in against the small side faces and end faces and joined to the same. The packing containers finally have a vertical seal 6 of the overlap type extending longitudinally over parts of the end faces 3. Adjointing the seal 6 can be seen a large number of depressions of ducts 7 which are formed in the packing laminate and whose function will be described in more detail in the following with special reference to FIG. 2.

Figure 2:
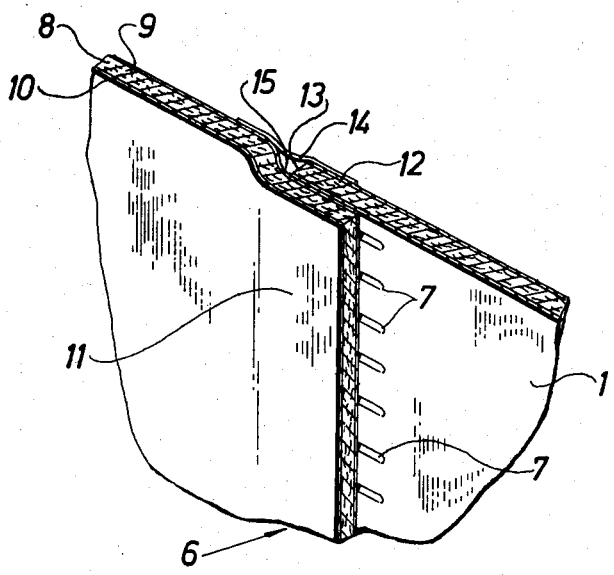
FIG. 2 shows on a larger scale a section through a seal in the packing container according to FIG. 1.

FIG. 2 shows on a larger scale a section through part of the seal and the side face 1 of the packing container according to FIG. 1. The figure clearly shows how the packing laminate is composed of different layers, namely a central layer 8 which is relatively thick and consists of paper, and relatively thin layers 9, 10 of homogeneous thermoplastic material, e.g. polythene, applied on both sides of the same. The figure also shows how the longitudinal seal 6 is formed as an overlapping joint in that the edge areas 11 and 12 of the packing laminate have been brought together to overlap one another, whereupon the two thermoplastic layers 9 resting against one another are heated and pressed together.

The cut edge 13 of the edge area 12 is situated inside the packing container and is covered by a sealing material strip 14 which runs along the whole length of the seal. The sealing strip 14 is made of the same material as the sealing layer of the laminate, that is to say, polythene, and can therefore be simply joined to the layer 9 by thermosealing. The grooves 7 are constituted of indentations or depressions in the surface of the packing laminate in the edge area 12 which faces towards the edge area 11. The depressions 7 extend substantially at a right angle from the cut edge 13 and are of such a length that they reach with their opposite end beyond the sealing zone of the edge areas 11 and 12. As a result the grooves 7 together with the edge area 11 form ducts which extend from the elongated space 15 which is delimited by the edge area 11, the cut edge 13 and the sealing material strip 14 to the outside of the packing container.

The grooves 7, as mentioned earlier, consist of depressions or indentations in the material surface. The grooves are made preferably by passing the material through a roller whose peripheral surface is provided with ribs of dimensions corresponding to the grooves 7. In a typical packing material with a total thickness of approx. 0.5 mm the grooves may have a depth of approx 0.1 mm. The length of the grooves exceeds by a few millimeters the width of the sealed area and as a typical value with a sealing width of 7 mm, a groove length of 9 mm has proved appropriate.

The manufacture of the packing containers in accordance with the invention may take place e.g. in the known type of machine described earlier which for the purpose is additionally provided with a wheel or a roller so as to achieve the desired pattern. The material is made to pass the roller before conversion to tubular form, so that the edge area 12 of the material web 1 has been provided with depressions 7 when the longitudinal seal 6 is formed. During the subsequent heating of the material with the object of eliminating superfluous sterilizing agent and ensuring a good sterilization effect the moisture included in the paper layer 8 of the material will, as mentioned previously, commence to boil and be converted to vapour. The moisture in the edge area 12 will escape via the cut surface 13 and fill the elongated space 15. Owing to the presence of the depressions or ducts 7 in accordance with the invention the vapour can then escape to the surrounding air via the ducts 7 without any major pressure being created in the space 15. The sealing material strip 14 warmed up by the heat to its softening temperature thus fails to be subjected to any pressure from the expanding vapour in the space 15 and as a result the risk of the material strip being penetrated or deformed has been fully eliminated. Since the material strip remains intact and thus ensures complete tightness of the sealed area, the ducts 7 do not bring about any disadvantage from a point of view of tightness.

The embodiment described with ducts in the form of pressed, transverse recesses in the material has proved very suitable, since it provides a good ventilation for the vapour formed whilst the depressions can be produced at very low cost without any appreciable changes in the machine for the manufacture of packing containers of the present type. Naturally, the ducts may also be given a different shape and it is even conceivable to give the ducts the form of a series of holes which penetrate through the outside edge area 11 in front of the space 15. However, such an embodiment in most cases does not represent an advantage over the embodiment described, which provides perfectly satisfactory ventilation without any kind of weakening of the packing material.

Finally, it is also possible to provide one edge area of the packing laminate web with a series of depressions at an earlier stage, i.e. in connection with the production of the laminate. Such a laminate can be used in presently existing packing machines without any alterations of the machines, which can be advantageous in certain cases. Such a laminate is preferably given the same preferred form of indentations or depressions as earlier described, i.e. a series of grooves extending transversely from the edge of the web. The grooves should of course be placed on that surface of the laminate, which is intended to form the outside of the finished packing container.

What is claimed is:

1. A packing container comprising:

a first edge area;

a second edge area overlapped onto the first edge area forming a wall of the packing container;

sealing means for sealing the first edge area to the second edge area disposed on a side of the wall facing the inside of the packing container; and duct means for venting a space, formed between the sealing means and the wall, towards the outside of the packing container.

2. The packing container of claim 1 wherein the duct means is arranged between the first edge area and the second edge area.

3. The packing container of claim 1 wherein the duct means comprises a plurality of depressions formed in at least one of the first and the second edge areas.

4. The packing container of claim 3 wherein the depressions comprise grooves extending perpendicular with respect to a longitudinal direction of the sealing means.

5. The packing container of claim 3 or 4 wherein the depressions have an axial length which is greater than a width of one of the first and second edge areas.

6. The packing container of claim 3 wherein the depressions each have a depth of approximately 0.1 millimeters.

7. The packing container of claim 1 wherein the packing container is composed of laminated material and the sealing means comprises a sealing strip composed of the same material as a sealing layer of the laminate.

8. In a seal for a packing container composed of laminated material wherein the seal is formed by a first edge area which is overlapped onto a second edge area and wherein a side of the seal facing the inside of the packing container is covered with a sealing strip, the improvement comprising duct means for venting a space formed between the sealing strip and the packing container to the outside of the packing container, said duct means being arranged between the first edge area and the second edge area.

9. In the seal of claim 8 the further improvement wherein the duct means comprises a plurality of depressions extending perpendicular with respect to a longitudinal direction of the seal formed in at least one of the first and the second edge areas.

10. In the seal of claim 9 the further improvement wherein the depressions extend an axial length which is greater than a width of one of the first and second edge areas.

11. A packing material web for the production of a packing container wherein at least one edge area of the web is provided with a plurality of depressions, and each of the depressions comprises a groove extending perpendicularly with respect to an edge of the web.

12. A method of forming a packing container comprising the steps of:

overlapping a second edge area onto a first edge area to form a wall of the packing container;

placing a sealing strip along a side of the wall facing the inside of the packing container;

sealing the sealing strip to the first edge area and the second edge area; and venting a space formed between the sealing strip and the wall towards the outside of the packing container.

13. The method of claim 12 wherein the step of venting the space includes forming a plurality of depression in at least one of the first and second edge areas extending an axial length which is greater than a width of one of the first and second edge areas.

* * * * *